US005847333A

United States Patent [19]

D'Hoogh

[11] Patent Number: 5,847,333

[45] Date of Patent: Dec. 8, 1998

[54] ELECTRODYNAMIC LOUDSPEAKER AND SYSTEM COMPRISING THE LOUDSPEAKER

[75] Inventor: Guido D'Hoogh, Dendermonde, Belgium

[73] Assignee: U.S. Philips Corporation, New York, N.Y.

[21] Appl. No.: 859,590

[22] Filed: May 20, 1997

[30] Foreign Application Priority Data

May 31, 1996 [EP] European Pat. Off. ..... 96201518

[51] Int. Cl.[6] ..... G10K 13/00; H04R 25/00

[52] U.S. Cl. ..... 181/171; 181/172; 181/156; 381/193

[58] Field of Search ..... 181/171, 172, 181/173, 174, 199, 156; 381/188, 192, 193, 198, 205

[56] References Cited

U.S. PATENT DOCUMENTS 2,490,466 12/1949 Olson et al. ..... 181/171
2,630,189 3/1953 Julie ..... 181/172
3,905,448 9/1975 Kawakami et al. ..... 181/172
5,111,510 5/1992 Mitobe ..... 181/172

FOREIGN PATENT DOCUMENTS 7502568 11/1975 Germany .

*Primary Examiner*—Khanh Dang

[57] ABSTRACT

An electrodynamic loudspeaker comprising a chassis, a diaphragm, and an actuator. The diaphragm is disposed within the chassis and has a front part and a back part. The actuator comprises a first actuator part connected to the diaphragm and a second actuator part connected to the chassis to cooperate with the first actuator part via an air gap. In order to obtain a large amplitude of the diaphragm a sub-chassis extends between the chassis and the diaphragm, a first flexible connecting element connecting the diaphragm to the sub-chassis, and a second flexible connecting element connecting the sub-chassis to the chassis.

16 Claims, 4 Drawing Sheets

ELECTRODYNAMIC LOUDSPEAKER AND SYSTEM COMPRISING THE LOUDSPEAKER

BACKGROUND OF THE INVENTION

The invention relates to an electrodynamic loudspeaker comprising a chassis, a diaphragm having a front part and a back part and disposed within the chassis, a suspension means for movably suspending the diaphragm from the chassis, an electromagnetic actuator comprising a first actuator part connected to the back part of the diaphragm and a second actuator part connected to the chassis to cooperate with the first actuator part via an air gap.

Such a loudspeaker is known from DE-U 75 02 568. The known loudspeaker comprises a chassis and a conical diaphragm, which at an open front part has an omega-shaped mounting rim secured to the chassis. At a cylindrical central back part, which is disposed opposite the front part, the diaphragm is secured to the chassis via a corrugated compliant centering ring. The known loudspeaker further comprises an electromagnetic driver for driving the diaphragm in an axial direction, i.e. in the direction of a central axis of the conical diaphragm. The driver comprises a magnet system, which is secured to the chassis and has an air gap, and a coil, which is secured to the central back part and extends in the air gap. The suspension used for the diaphragm, particularly the omega-shaped rim, allows only limited axial excursions of the diaphragm relative to the chassis, owing to the limited extensibility of the mounting rim. As a result of this, a comparatively large diaphragm, particularly as viewed in the transverse direction, is required in order to achieve a satisfactory bass response.

SUMMARY OF THE INVENTION

It is an object of the invention to improve the loudspeaker of the type defined in the opening paragraph so as to obtain a loudspeaker of compact dimensions in combination with a satisfactory bass response.

According to the invention, the electrodynamic loudspeaker in accordance with the invention is characterized by the presence of a sub-chassis, which extends between the chassis and the diaphragm, the suspension means connecting the sub-chassis telescopically to the diaphragm and telescopically to the chassis. Owing to the use of a sub-chassis an axial excursion of the diaphragm relative to the chassis is determined by a first axial excursion of the diaphragm relative to the sub-chassis and a second axial excursion of the sub-chassis relative to the chassis. For completeness' sake, it is to be noted that axial excursions are to be understood excursions oriented along the central axis of the diaphragm, which axis extends from one part of said parts to the other part of said parts of the diaphragm. The maximum axial excursion of the diaphragm is also referred to as the stroke or amplitude of the diaphragm.

Since the loudspeaker in accordance with the invention comprises a sub-chassis which is axially movable with respect to the chassis and the diaphragm, a large excursion of the diaphragm can be obtained by the use of a suspension means which fully complies with the imposed mechanical and acoustical requirements, without this giving rise to distortion in the reproduction of sound. The sub-chassis apparently assists the suspension means, as a result of which undesired oscillations caused by pressure variations and/or parasitic resonances are counteracted.

Owing to the large axial excursions to be performed by the diaphragm relative to the chassis the loudspeaker in accordance with the invention can have limited transverse dimensions and can therefore be of a compact construction. The diaphragm used will generally be at least substantially conical and have an open front part. In the case of a conical diaphragm of circular cross-section the measure in accordance with the invention results in a loudspeaker of small diameter in relation to the capability of the loudspeaker of producing high sound pressures.

The loudspeaker in accordance with the invention is particularly suitable for uses where not much space is available, such as the limited mounting space in a car, a television set or a monitor, but where comparatively high power handling capacities are desired.

An embodiment of the loudspeaker in accordance with the invention is characterized in that the suspension means comprises a first flexible connecting element, which connects the diaphragm to the sub-chassis, and a second flexible connecting element, which connects the sub-chassis to the chassis. Preferably, the suspension means is disposed near the front part of the diaphragm. When a suspension means which fully complies with the imposed mechanical and acoustical requirements is used, a large excursion of the diaphragm can be obtained without this giving rise to distortion in the reproduction of sound.

Preferably, the loudspeaker in accordance with the invention comprises ring-shaped connecting elements. Such connecting elements are preferably coaxially positioned with respect to each other. Preferably, the connecting elements each have a corrugated or undulate structure. Such a structure is known per se and is used in known loudspeakers as a mounting rim for securing a diaphragm to a chassis, which rim may then have one or more concentric corrugations or an omega-shaped or sinusoidal undulate structure. In known loudspeakers the degree to which the mounting rim is extensible determines the excursion of the diaphragm. The shape and dimensions of such a rim lie within narrow limits, which are dictated inter alia by the required resistance to pressure variations prevailing in operation and the ability to deform smoothly, i.e. without annoying symptoms, such as collapsing or bulging, during excursions of the diaphragm. A mounting rim which is too compliant and/or not smoothly deformable gives rise to distortion, particularly second and higher harmonic distortion in the reproduction of sound and, consequently, to undesirable noises. Therefore, enlarging the mounting rim in an axial and/or radial direction in the loudspeaker known from said DE-U 75 02 568 will not yield a satisfactory result. Indeed, if an increase of the excursion of the diaphragm is obtained, this will be attended by a deteriorated sound reproduction because the mechanical resistance of the mounting rim is reduced and undesired resonances of the rim are produced.

In the loudspeaker in accordance with the invention the connecting elements are preferably positioned so as to be coaxial with one another. The first connecting element and the second connecting element are then, for example, coplanar.

The connecting elements used in the loudspeaker in accordance with the invention mainly allow excursions of the diaphragm along a translation axis of the diaphragm and impede other movements, the translation axis being coincident with the central axis of the diaphragm. In other words, the connecting elements are comparatively compliant viewed in an axial direction and comparatively stiff in other directions, which guarantees well-defined excursions of the diaphragm.

An embodiment of the loudspeaker in accordance with the invention is characterized in that the suspension means is disposed near the front part of the diaphragm, a flexible centering element being disposed near the back part, which centering element connects the sub-chassis to the back part. The centering element, which is preferably ring-shaped or disc-shaped, preferably allows movements of the diaphragm and the sub-chassis relative to one another in axial directions and counteracts other movements relative to one another. This makes it possible to preclude tilting movements of the diaphragm relative to the sub-chassis.

An embodiment of the loudspeaker in accordance with the invention is characterized in that the sub-chassis has an at least substantially imperforate circumferential surface. The circumferentially imperforate sub-chassis, together with the basically imperforate diaphragm and the centering element, forms an air chamber, which damps out parasitic resonances as a result of the fact that the diaphragm and the sub-chassis are in anti-phase with one another. On account of small volume variations in the air chamber as a result of relative displacements of the diaphragm and sub-chassis it is preferred to provide a limited air passage for the centering element and/or the sub-chassis. For this purpose, the centering element can, for example, be made of a textile fabric which has been impregnated and which is permeable to air to a given extent.

If the diaphragm is conical, it is preferred in order to obtain a desired damping, to adapt the shape of the sub-chassis thereto and to make it also conical.

An embodiment of the loudspeaker in accordance with the invention is characterized by the presence of a flexible connecting member, which connects the sub-chassis to the chassis at least substantially at the location of the back part of the diaphragm. The flexible connecting member, which preferably permits movements of the sub-chassis relative to the chassis in directions substantially along the central axis and counteracts other movements, provides a rectilinear guidance of the sub-chassis. Preferably, the connecting member has the same properties, particularly mechanical properties, as the second connecting element. In a practical embodiment the connecting member and the second connecting element can each be constructed as an omega-shaped rim. Preferably, the corrugation crests of the two facing rims are oriented towards or away from one another in order to obtain a symmetrical suspension.

An embodiment of the loudspeaker in accordance with the invention is characterized in that the connecting member has a corrugated or undulate structure.

An embodiment of the loudspeaker in accordance with the invention is characterized in that between the centering element and the connecting member, on the one hand, and the actuator, on the other hand, a space extends which is surrounded by a chassis part having a sound aperture. The presence of one or more sound apertures in said part guarantees a suitable acoustic communication between the diaphragm and an enclosure adapted to cooperate with the loudspeaker.

An embodiment of the loudspeaker in accordance with the invention is characterized in that the sub-chassis has a circumferential surface having an opening, a flexible connecting member being provided which connects the sub-chassis to the chassis at least substantially at the location of the back of the diaphragm, a space being provided which is surrounded by the centering element, the connecting element, the actuator and a chassis part having at least one sound aperture. Volume variations in the space surrounded by the centering member, the connecting element, the actuator and the chassis part having a sound aperture are damped out by the flow resistance in the sound aperture or sound apertures. Preferably, a resistance element, such as a textile fabric, is applied into the sound aperture or sound apertures.

The invention further relates to an electrodynamic loudspeaker comprising a chassis, a diaphragm having a front part and a back part and disposed within the chassis, a suspension means arranged near the front part of the diaphragm, for flexibly suspending the diaphragm from the chassis, an electromagnetic actuator comprising a first actuator part connected to the back part of the diaphragm and a second actuator part connected to the chassis to cooperate with the first actuator part via an air gap, which loudspeaker is characterized by the presence of a sub-chassis, which extends between the chassis and the diaphragm, the suspension means comprising a first flexible connecting element, which connects the diaphragm to the sub-chassis, and a second flexible connecting element, which connects the sub-chassis to the chassis. This loudspeaker has the same favourable properties as mentioned in the preceding part of the description and can have the same characteristic features as defined for the various embodiments.

The invention further relates to a loudspeaker system comprising the electrodynamic loudspeaker in accordance with the invention and an enclosure for the loudspeaker. If desired, the loudspeaker system may be provided with a passive radiator or another higher-order reflex system, such as a system with a bass-reflex pipe.

The invention moreover relates to a device for providing audible and/or visual information and accommodating the loudspeaker system in accordance with the invention. Such a device is, for example, an electronic display device.

BRIEF DESCRIPTION OF THE DRAWINGS

The invention will now be described in more detail, by way of example, with reference to the accompanying drawings, in which.

DETAILED DESCRIPTION

Figure 1:
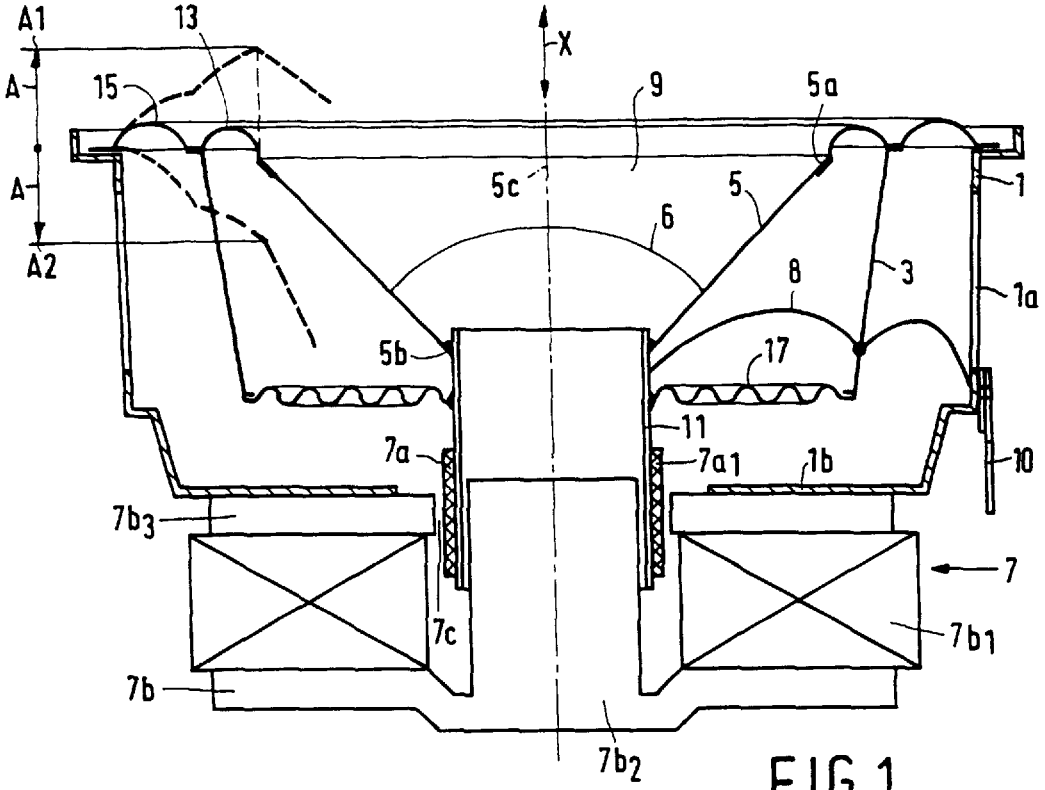
FIG. 1 is a longitudinal sectional view showing a first embodiment of the loudspeaker in accordance with the invention.

The loudspeaker in accordance with the invention shown in FIG. 1 comprises a chassis 1, a sub-chassis 3, a diaphragm 5, and an electromagnetic actuator 7. In the present embodiment the chassis 1 has a substantially conical shape. The sub-chassis 3, which has a conical shape in the present example, extends between the chassis 1 and the diaphragm 5, which has a conical shape in the present example. In this example a dust cap 6 is situated in the diaphragm 5. The sub-chassis 3 has a circumferential surface disposed opposite the sound apertures la in the chassis 1 which surface may be imperforate or with openings. The diaphragm 5, which is disposed at least partly within the sub-chassis 3, has a first part, i.e. a front part 5*a* with an aperture 9, and a second part, i.e. a back part 5*b* with a cylindrical central element 11. The element 11 carries a first actuator part 7*a* of the actuator 7, which part is formed by a coil 7*a*1 in the present example. The coil 7*a*1 is electrically connected to contact terminals 10 via electrical conductors 8, which terminals have been secured to the chassis 1. The actuator 7 further comprises a second actuator part 7*b*, which in the present example comprises a ring magnet 7*b*1, a yoke part 7*b*2 and a yoke part 7*b*3 secured to a chassis part 1*b* of the chassis 1. Between the yoke part 7*b*2 and the yoke part 7*b*3 an air gap 7*c* is formed, in which the coil 7*a*1 extends. When the actuator is energized the coil 7*a*1 and hence the diaphragm 5 perform an axial movement along a diaphragm axis 5*c* in one or in the other axial direction indicated by the double arrow x.

In the loudspeaker in accordance with the invention the diaphragm 5 is suspended in the sub-chassis 3 and the sub-chassis 3 is suspended in the chassis 1. For this purpose, the loudspeaker has been provided with a first flexible connecting element 13, which connects the front part 5*a* of the diaphragm 5 to the sub-chassis 3, and a second flexible connecting element 15, which connects the sub-chassis 3 to the chassis I at the location of the front part 5*a*. In the present example the connecting elements 13 and 15 are each formed by a ring-shaped rim of omega-shaped cross-section. The connecting elements 13 and 15, made of polyurethane in the present example, can be secured to the diaphragm 5 and the sub-chassis 3 and to the sub-chassis 3 and the chassis 1, respectively, by adhesive joints. Preferably, the first connecting element 13 and the second connecting element 15, which are coaxial with one another, are constructed as a one flexible element.

The loudspeaker in accordance with the invention further comprises a flexible centering element 17, in the present example in the form of a centering disc having a concentric corrugation pattern and made of, for example, an impregnated textile fabric, which element connects the sub-chassis 3 to the back part 5*b*, particularly the central element 11 thereof. The centering element 17 and the connecting elements 13 and 15 form supporting means which are comparatively compliant in the axial directions indicated by the arrow x but which are preferably comparatively stiff in the other directions, as a result of which the diaphragm 5 with the coil 7*a*1 as well as the sub-chassis 3 can perform well-defined axial movements relative to the chassis 1.

In operation the sub-chassis and the chassis as well as the sub-chassis and the diaphragm form a telescopic suspension device.

In FIG. 1 the diaphragm 5 is shown in a rest position. In the case of the maximum excursion the diaphragm is in one of the positions marked A1 and A2, respectively. The excursion or amplitude is designated A.

Figure 2:
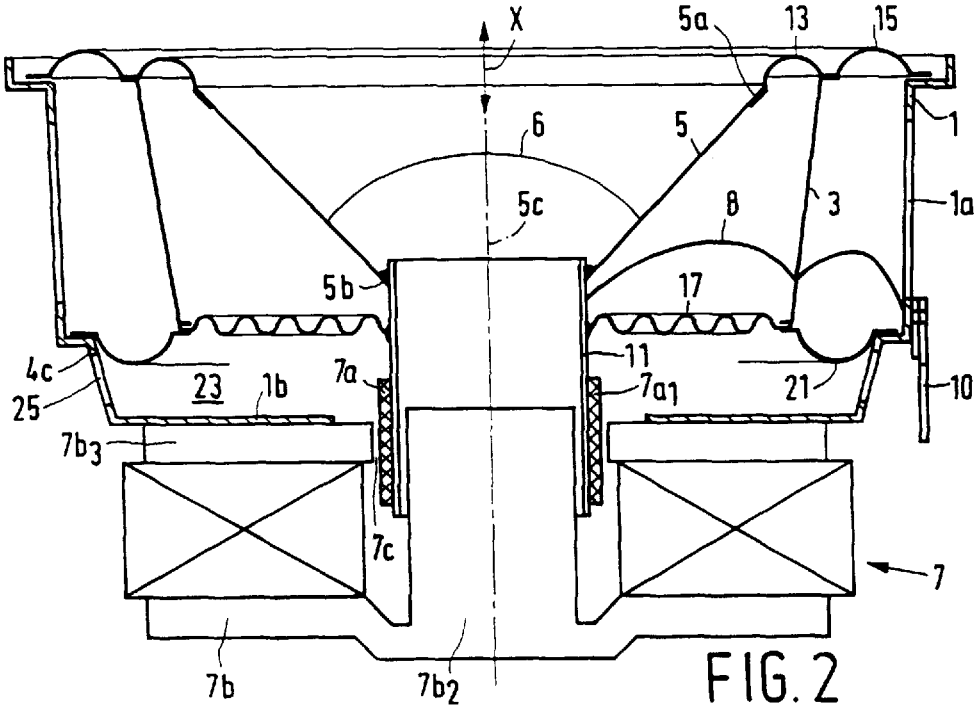
FIG. 2 is a longitudinal sectional view showing a second embodiment of the loudspeaker in accordance with the invention.
Figure 3:
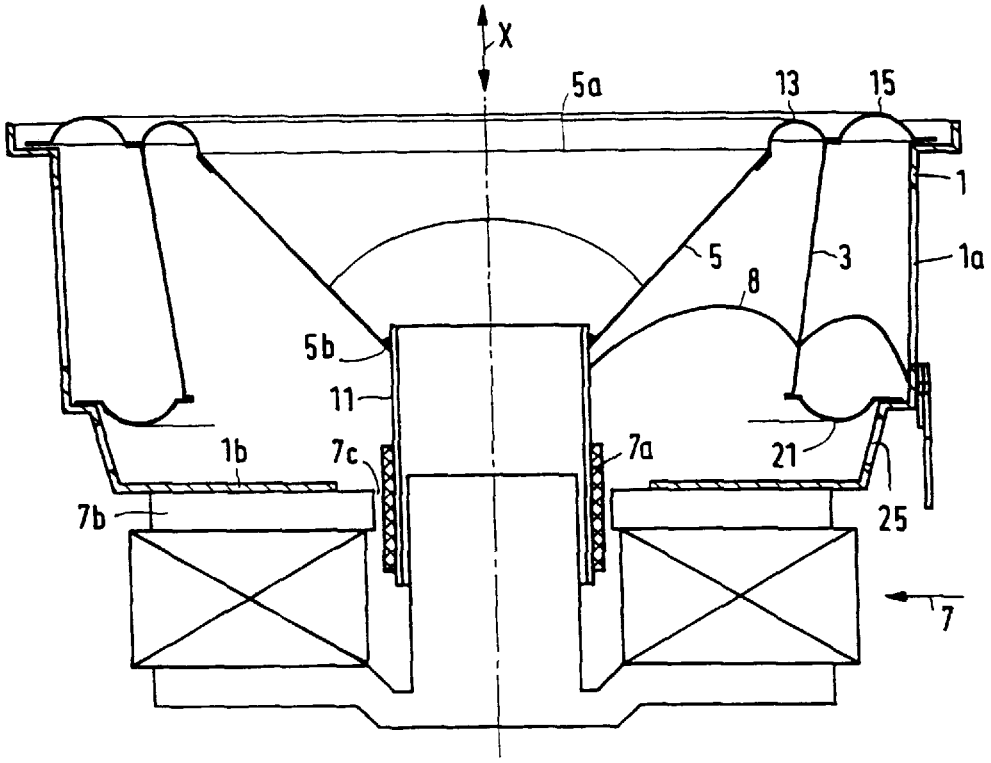
FIG. 3 is a longitudinal sectional view showing a third embodiment of the loudspeaker in accordance with the invention.
Figure 4:
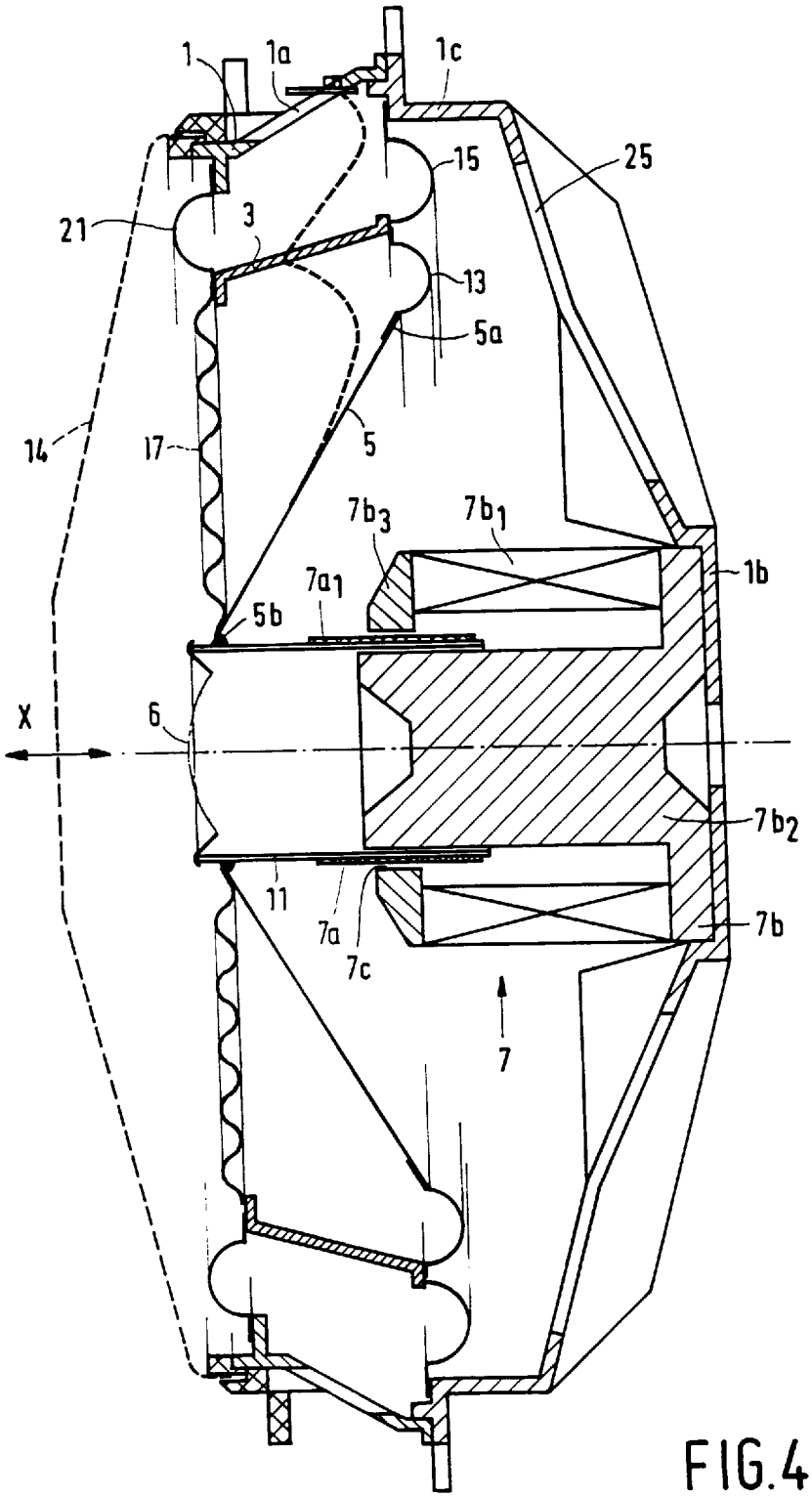
FIG. 4 is a longitudinal sectional view showing a fourth embodiment of the loudspeaker in accordance with the invention.

The embodiments shown in FIGS. 2, 3 and 4 bear much resemblance to the embodiment already described. For this reason corresponding parts in FIGS. 1 to 4 bear the same reference numerals.

The loudspeaker shown in FIG. 2 comprises a chassis 1 with sound apertures 1*a* and a conical diaphragm 5 disposed within the chassis 1, which diaphragm has an open front part 5*a* and a back part 5*b*, disposed opposite this front part. The loudspeaker further comprises an electromagnetic actuator 7 having a first actuator part 7*a* connected to the back part 5*b* and a second actuator part 7*b* connected to the chassis 1, the two actuator parts 7*a* and 7*b* cooperating magnetically with one another via an air gap 7*c* during operation. The loudspeaker further comprises a sub-chassis 3, which extends between the chassis 1 and the diaphragm 5, a first flexible connecting element 13 connecting the diaphragm 5 to the sub-chassis 3 and a second flexible connecting element 15 connecting the sub-chassis 3 to the chassis 1 at the location of the front part 5*a*. At the location of the back part 5*b* a flexible centering element 17 connects the diaphragm 5 to the sub-chassis 3, in the present example via a central element 11 secured to the diaphragm 5, and a flexible connecting element 21 connects the sub-chassis to the chassis 1. In this example the connecting element 21 and the connecting elements 13 and 15 each take the form of an omega-shaped rim of a flexible material, particularly polyurethane, the connecting element 21 and the facing connecting element 15 being disposed in mirror-inverted positions relative to one another. The centering element 17, the connecting element 21 and the connecting elements 13 and 15 form such a suspension for the diaphragm 5 that the latter is movable almost exclusively along its central axis 5*c*, i.e. in the directions x.

The first actuator part 7*a* of the actuator 7 comprises a coil 7*a*1 secured to the element 11 and connected to terminals 10 via an electrical conductor 8 and the second actuator part 7*b* comprises a permanent magnet 7*b*1 and soft-magnetic yoke parts 7*b*2 and 7*b*3. The second actuator part 7*b* is secured to a base 1*b* of the chassis 1. If desired, the first actuator part 7*a* may comprise a magnet instead of a coil and the second actuator part 7*b* may comprise a coil instead of a magnet. The magnet of the actuator may optionally be replaced by a coil.

A space 23 provided between the centering element 17 and the connecting element 21, on the one hand, and the actuator 7, on the other hand, communicates with the surrounding space via one or more sound apertures 25 in a chassis part 1*c*.

The loudspeaker in accordance with the invention shown in FIG. 3 comprises a chassis 1, a diaphragm 5, a sub-chassis 3 and an electromagnetic actuator 7. The chassis 1 has a chassis part 1*b* forming the base and has sound apertures 1*a* and 25. The chassis part 1*b* carries a magnet system forming the second actuator part 7*b* of the actuator 7. A drive coil forming the first actuator part 7*a* of the actuator 7 is secured to a cylindrical element 11 of a back part 5*b* of the diaphragm 5. When the coil 7*a* is energized the coil 7*a* and hence the diaphragm 5 performs translatory movements in axial directions as indicated by the arrow x. The diaphragm 5 has an open front part 5*a* opposite the back part 5*b*. The sub-chassis 3 is interposed between the diaphragm 5 and the chassis 1, the diaphragm 5 being secured to the sub-chassis 3 by means of a first connecting element 13, which is flexible mainly in axial directions x, and the sub-chassis 3 being secured to the chassis 1 by means of a second flexible connecting element 15 and a flexible connecting member 21. The first and the second connecting element 13 and 15 are situated at the location of the front part 5*a* and the connecting element 21 is disposed at the location of the back part 5*b* of the diaphragm 5.

The loudspeaker in accordance with the invention shown in FIG. 4 comprises a chassis 1 having a chassis part 1*b* forming the base and a chassis part 1*c* forming a circumferential wall and has sound apertures la and 25. The loudspeaker further comprises a diaphragm 5 having a first part 5*a* forming the front part and a second part 5*b* forming the back part, the diaphragm 5 being tapered from the first part 5*a* to the second part 5*b*. The front part 5*a* is open and has been provided with a central sleeve-shaped or cylindrical part 11. The loudspeaker further comprises a sub-chassis 3, which extends between the diaphragm 5 and the chassis 1. Near its front part 5*a* the diaphragm 5 is suspended from the sub-chassis 3 by a first flexible connecting element 13 and, at the location of the front part 5*a*, the sub-chassis 3 is suspended from the chassis 1 by means of a second flexible connecting element 15. Furthermore, at the location of the back part 5*b* of the diaphragm 5 the sub-chassis 3 is secured to the chassis 1 via a flexible suspension member 21. A flexible centering element 17 extends between the sub-chassis 3 and the back part 5*b*. The combination of the sub-chassis 3, the elements 13, 15 and 17 and the member 21 allow a large excursion of the diaphragm 5 relative to the chassis 1 in the directions x. An electromagnetic actuator 7 has been provided to drive the diaphragm 5 and has a first actuator part 7*a* connected to the diaphragm 5, via a connection to the central element 11 of the back part 5*b*, and has a second actuator part 7*b* connected to the chassis I via a connection to the base 1*b* of the chassis 1. The first actuator part 7*a* comprises a coil 7*a*1, which extends in an air gap 7*c* of a magnetic yoke of the second actuator part 7*b*, which yoke comprises soft-magnetic parts 7*b*2 and 7*b*3. The second actuator part 7*b* further comprises a ring-shaped permanent magnet 7*b*1. The back part 5*b* of the diaphragm 5 has been provided with a dust cap 6, which seals against dust. In the present example the loudspeaker further comprises a protective grill 14.

Figure 5:
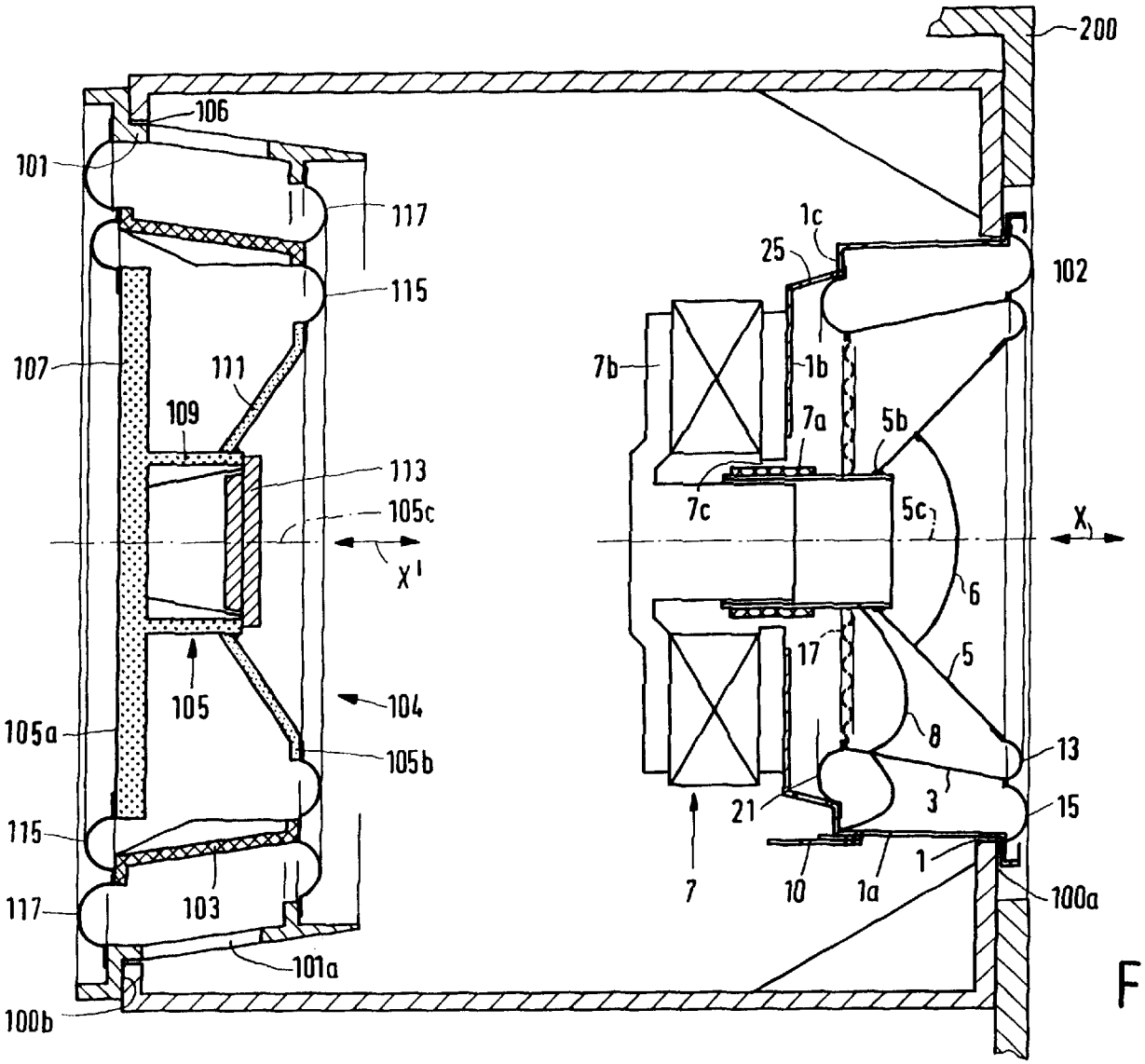
FIG. 5 is a longitudinal sectional view showing an embodiment of the system in accordance with the invention.

The system in accordance with the invention shown in FIG. 5, which in the present example is used in an electronic display device 200 for providing visual information, comprises a housing or enclosure 100, which accommodates a loudspeaker in accordance with the invention, in the present example the embodiment shown in FIG. 2. The housing 100 has an opening 102 through which the chassis 1 of the loudspeaker extends, which chassis 1 is secured to an edge portion 101*a* of the housing around the opening 102. For a further description of the loudspeaker reference is made to those parts of the present document which relate to FIG. 2.

The system shown in FIG. 5 is constructed, by way of example, as a bass-reflex loudspeaker system and comprises a passive radiator. For this purpose, the housing has a further opening 106, through which a chassis 101 of the passive radiator 104 extends. The chassis 101 is secured to an edge portion 100*b* of the housing 100 around the opening 106. The passive radiator 104 further comprises a sub-chassis 103 and a mass element 105. The chassis 101 in the present example has apertures 101*a* and the sub-chassis 103 in the present example is formed by a solid of revolution with or without openings. The mass element 105 in the present example comprises a plate-shaped or disc-shaped part 107, a cylindrical central part 109 and a conical part 111. The central part 109 carries a tuning mass 113 by means of which the desired Helmholtz resonance of system is tuned. A front part 105*a* and a back part 105*b* can be assigned to the mass element 105. The passive radiator 104, which is described in more detail in the non-prepublished U.S. patent application bearing the application No. 08/859,589 (presently indicated as having allowable subject matter; herewith incorporated by reference), further comprises first flexible connecting elements 115, which connect the mass element flexibly to the sub-chassis 103, and second connecting elements 117, which connect the sub-chassis 103 flexibly to the chassis 101. The first connecting elements 115 connect both the front part 105*a* and the back part 105*b* of the mass element 105 to the sub-chassis 103 and the second connecting elements 117 connect the sub-chassis 103 to the chassis 101 both at the location of the front part 105*a* and at the location of the back part 105*b*. In this example the connecting elements take the form of ring-shaped rims of omega-shaped cross-section, the first connecting elements 115 as well as the second connecting elements 117 being disposed in mirror-inverted positions relative to one another. In the present example the rims are made of polyurethane. However, they can alteratively be made of another suitable material, such as rubber. Under the influence of pressure variations, produced by the loudspeaker, the mass element 105 performs axial movements x' along its central axis 105*c*, the amplitude being the sum of the maximum excursion of the mass element 105 relative to the sub-chassis 103 and the maximum excursion of the sub-chassis 103 relative to the chassis 101. Instead of the passive radiator shown another type of passive radiator or a bass-reflex pipe can be used.

It is to be noted that the invention is not limited to the embodiments disclosed herein. For example, instead of omega-shaped connecting elements and/or members sinusoidal or other suitably shaped connecting elements or members can be used. Moreover, the loudspeaker and the passive radiator in the system in accordance with the invention may be arranged side by side instead opposite one another.

What is claimed is:

1. An electrodynamic loudspeaker comprising a chassis, a diaphragm having a front part and a back part and disposed within the chassis, a suspension means for movably suspending the diaphragm from the chassis, an electromagnetic actuator comprising a first actuator part connected to the back part of the diaphragm and a second actuator part connected to the chassis to cooperate with the first actuator part via an air gap, wherein said speaker further comprises a sub-chassis, which extends between the chassis and the diaphragm, the suspension means connecting the sub-chassis telescopically to the diaphragm and telescopically to the chassis.

2. An electrodynamic loudspeaker as claimed in claim 1, wherein the suspension means comprises a first flexible connecting element, which connects the diaphragm to the sub-chassis, and a second flexible connecting element, which connects the sub-chassis to the chassis.

3. An electrodynamic loudspeaker as claimed in claim 2, wherein said connecting elements are ring-shaped and are coaxially positioned with respect to each other.

4. An electrodynamic loudspeaker as claimed in claim 2, wherein the connecting elements allow mainly movements of the diaphragm along an axis of translation of the diaphragm and counteract other movements.

5. An electrodynamic loudspeaker as claimed in claim 2, wherein the connecting elements each have a corrugated or undulate structure.

6. An electrodynamic loudspeaker as claimed in claim 1, wherein the suspension means is disposed near the front part of the diaphragm, a flexible centering element being disposed near the back part, which centering element connects the sub-chassis to the back part.

7. An electrodynamic loudspeaker as claimed in claim 1, wherein the sub-chassis has an at least substantially imperforate circumferential surface.

8. An electrodynamic loudspeaker as claimed in claim 1, wherein the diaphragm is at least substantially conical.

9. An electrodynamic loudspeaker as claimed in claim 8, wherein the sub-chassis is conical.

10. An electrodynamic loudspeaker as claimed in claim 1, wherein said speaker further comprises a flexible connecting member, which connects the sub-chassis to the chassis at least substantially at the location of the back part of the diaphragm.

11. An electrodynamic loudspeaker as claimed in claim 10, wherein the connecting member has a corrugated or undulate structure.

12. An electrodynamic loudspeaker as claimed in claim 6, wherein between the centering element and the connecting member, on the one hand, and the actuator, on the other hand, a space extends which is surrounded by a chassis part having a sound aperture.

13. An electrodynamic loudspeaker as claimed in claim 6, wherein the sub-chassis has a circumferential surface having an opening, a flexible connecting member being provided which connects the sub-chassis to the chassis at least substantially at the location of the back of the diaphragm, a space being provided which is surrounded by the centering element, the connecting element, the actuator and a chassis part having at least one sound aperture.

14. An electrodynamic loudspeaker comprising a chassis, a diaphragm having a front part and a back part and disposed within the chassis, a suspension means arranged near the front part of the diaphragm, for flexibly suspending the diaphragm from the chassis, an electromagnetic actuator comprising a first actuator part connected to the back part of the diaphragm and a second actuator part connected to the chassis to cooperate with the first actuator part via an air gap, wherein said speaker further comprises a sub-chassis, which extends between the chassis and the diaphragm, the suspension means comprising a first flexible connecting element, which connects the diaphragm to the sub-chassis, and a second flexible connecting element, which connects the sub-chassis to the chassis.

15. A loudspeaker system comprising an electrodynamic loudspeaker as claimed in claim 1 and an enclosure for accommodating the loudspeaker.

16. A device for providing audible and/or visual information and accommodating the loudspeaker system as claimed in claim 15.

* * * * *